US007663464B2

(12) United States Patent
Yamamoto et al.

(10) Patent No.: US 7,663,464 B2
(45) Date of Patent: Feb. 16, 2010

(54) INDUCTANCE COMPONENT

(75) Inventors: Kenichi Yamamoto, Osaka (JP); Michio Ohba, Osaka (JP); Nobuya Matsutani, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/016,653

(22) Filed: Jan. 18, 2008

(65) Prior Publication Data

US 2008/0186125 A1 Aug. 7, 2008

(30) Foreign Application Priority Data

Feb. 1, 2007 (JP) ..... 2007-022689

(51) Int. Cl.
*H01F 27/30* (2006.01)

(52) U.S. Cl. ..... 336/205

(58) Field of Classification Search ..... 336/65, 336/83, 200, 205–208, 232
See application file for complete search history.

(56) References Cited

U.S. PATENT DOCUMENTS 6,218,925 B1 * 4/2001 Iwao ..... 336/200
6,855,222 B2 * 2/2005 Konoue et al. ..... 156/89.16

FOREIGN PATENT DOCUMENTS

JP 2003-203813 7/2003

* cited by examiner

*Primary Examiner*—Tuyen Nguyen
(74) *Attorney, Agent, or Firm*—McDermott Will & Emery LLP

(57) ABSTRACT

The inductance component has a base material, a coil formed in the base material and an electrode electrically connected to the coil. In addition, an impact-absorption layer is disposed between the electrode and the base material. Forming impact-absorption layer between the base material and the electrode allows the base material to have flexibility even if an impact is given on the base material, providing the component with high impact-resistance.

6 Claims, 3 Drawing Sheets

INDUCTANCE COMPONENT

FIELD OF THE INVENTION

The present invention relates to an inductance component used for electronic equipment, such as a mobile phone.

BACKGROUND ART

FIG. 3 is a sectional view of a conventional inductance component. According to the conventional structure shown in FIG. 3, helical coil 2 is formed in resin-made, sheet-like base material 1 so as to have electrical connections with electrodes 3 disposed on the outer sides of base material 1. For example, Japanese Patent Unexamined Publication No. 2003-203813 is known in a prior-art reference relating to the present application.

Such structured conventional components can be impaired in the manufacturing process, specifically, in mounting operations by a nozzle-equipped mounting device. An absorption force for holding the component by the nozzle or an impact when the component is mounted on a printed circuit board has often caused a crack in base material 1, resulting in poor impact-resistance of the component.

SUMMARY OF THE INVENTION

The present invention addresses the problem. It is therefore the object of the present invention to enhance impact resistance of an inductance component having a base material.

The inductance component of the present invention has a base material, a coil formed in the base material and an electrode electrically connected to the coil. In the structure above, an impact-absorption layer is disposed between the electrode and the base material.

Forming the impact-absorption layer between the base material and the electrode allows the base material to have flexibility even if an impact is given on the base material, providing the component with high impact-resistance.

DETAILED DESCRIPTION OF THE INVENTION

First Embodiment

The exemplary embodiment of the present invention is described hereinafter with reference to the accompanying drawings.

Figure 1:
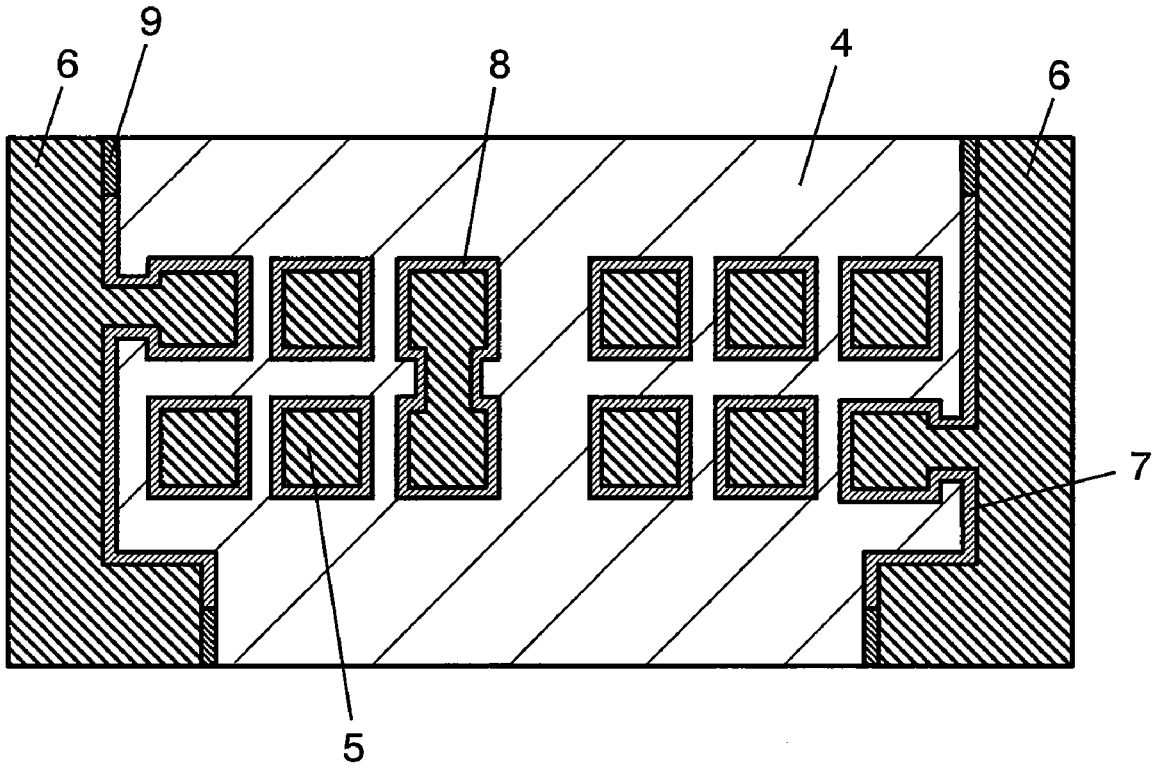
FIG. 1 is a sectional view of an inductance component of a first exemplary embodiment of the present invention.

FIG. 1 is a sectional view of an inductance component of the first exemplary embodiment of the present invention. According to the structure shown in FIG. 1, helical coil 5 is formed in resin-made, sheet-like base material 4. Both ends of coil 5 are electrically connected to electrodes 6 disposed on the outer sides of base material 4. Besides, impact-absorption layers 7 and 8, which are formed of an air gap, are disposed between electrodes 6 and base material 4, and between base material 4 and coil 5, respectively.

The structure above significantly improves impact resistance of the inductance component. Hereinafter will be given detailed explanation.

For example, in mounting operations by a nozzle-equipped mounting machine, the component is securely held by the nozzle through a face-to-face contact so as not to create a gap for passage of air from outside the nozzle. Such an intimate contact inevitably bears a force on the inductance component and the force is exerted on base material 4 of the component as an impact, which can cause a crack in base material 4. Not only because of the absorption force of the nozzle, but also because of an impact given on the component when the device mounts the component on a printed circuit board, a crack can develop in base material 4.

To address the problem above, the inductance component of the first exemplary embodiment has a structure where impact-absorption layer 7 is disposed between electrodes 6 and base material 4, at the same time, impact-absorption layer 8 is disposed between coil 5 and base material 4. By virtue of the impact-absorption layer, base material 4 has flexibility for absorbing an impact that can cause a crack, which minimizes the chances of causing a crack in base material 4.

Figure 2A:
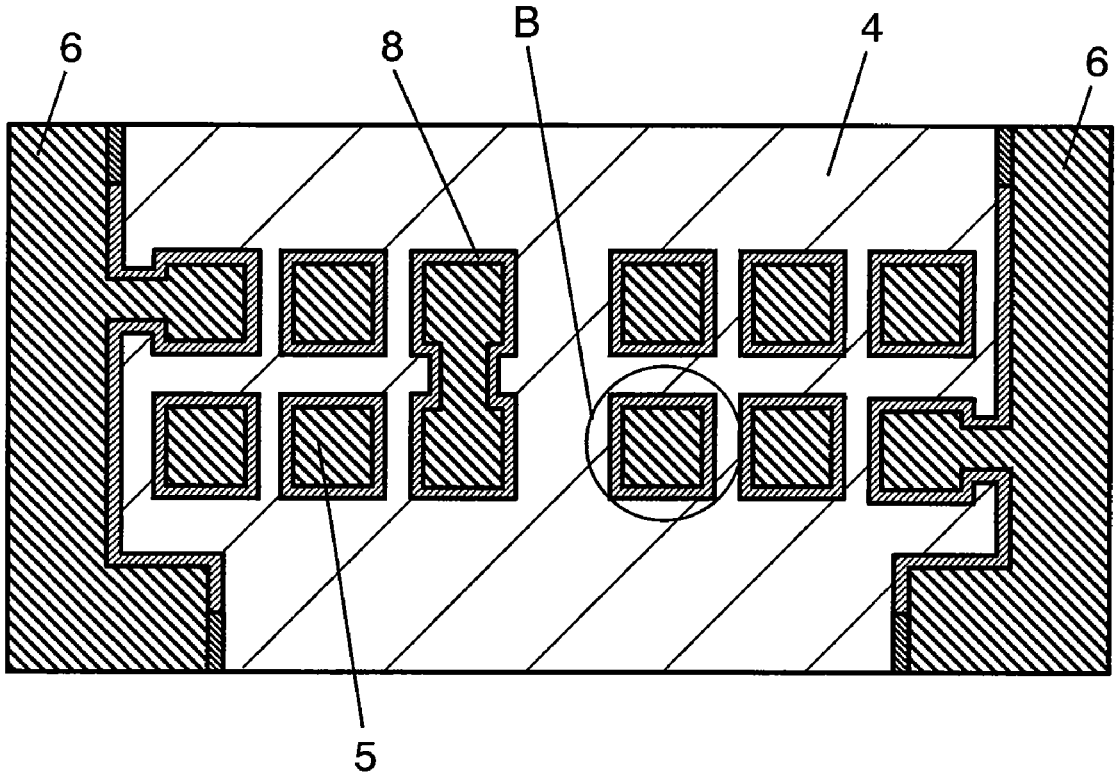
FIG. 2A is a sectional view of another example of the inductance component of the first exemplary embodiment.
Figure 2B:
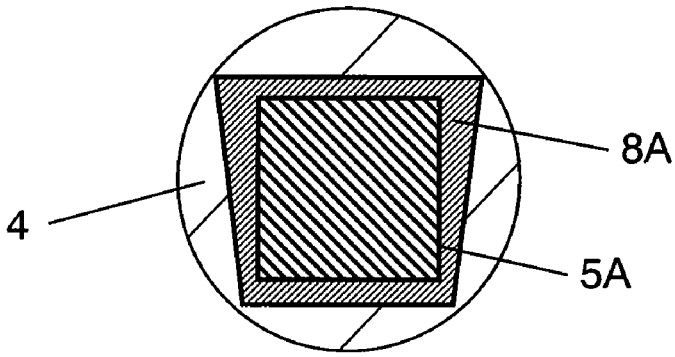
FIG. 2B is an enlarged sectional view of the B section in FIG. 2A.
Figure 3:
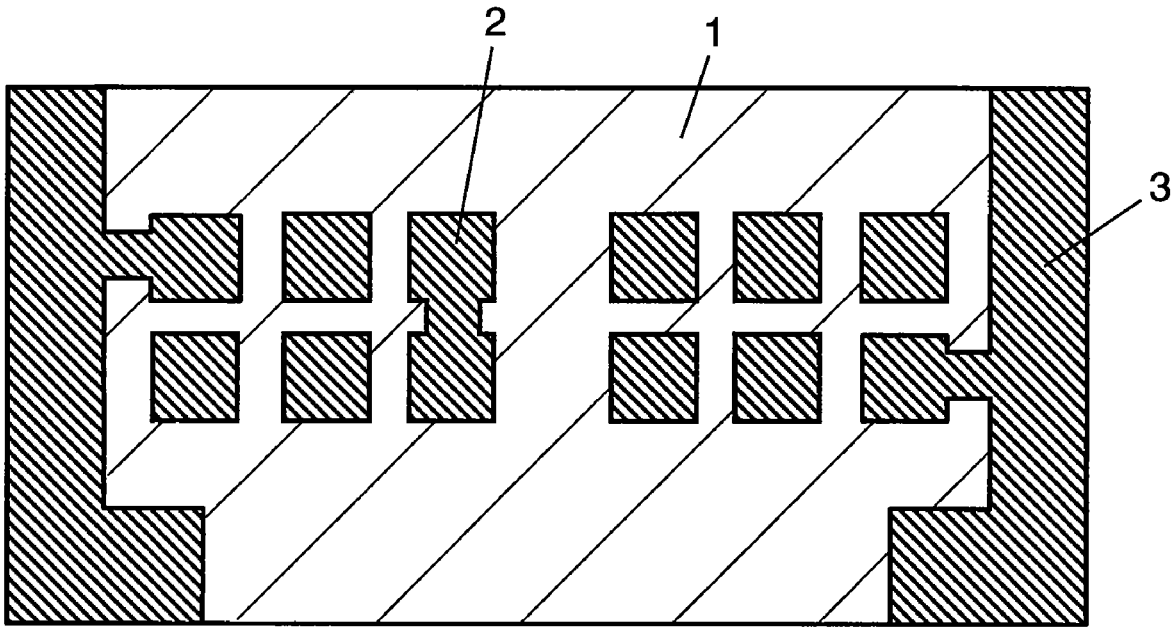
FIG. 3 PRIOR ART
FIG. 3 is a sectional view of a conventional inductance component.

FIG. 2A is a sectional view of another example of the inductance component of the first exemplary embodiment. FIG. 2B is an enlarged sectional view of the B section in FIG. 2A. As is shown in FIGS. 2A and 2B, impact-absorption layer 8A is formed between side section 5A of coil 5 and base material 4 in a manner that the thickness of layer 8A increases from the lower section toward the upper section. The gradually increased thickness of layer 8A is effective in absorbing an impact on the inductance component when the nozzle exerts a force.

When the nozzle downwardly exerts a force on an inductance component, only a mid section of the top surface of the component undergoes a stress from the upward direction. That is, the mid section of base material 4 is forced downwardly, whereas electrodes 6 formed in the outer sides of base material 4 are forced upwardly, resulting in a warpage of base material 4. The stress above causes a force contracting in a lateral direction at an upper section of base material 4 and a force expanding in a lateral direction at a lower section of base material 4. Considering above, impact-absorption layer 8A is formed into an effective structure; forming the thickness of impact-absorption layer 8A so as to increase from the lower section toward the upper section, as shown in FIG. 2B, effectively absorbs an impact on the component.

Although the embodiment introduces the structure in which the impact-absorption layer is disposed at two areas: between electrodes 6 and base material 4 (as impact-absorption layer 7) and between coil 5 and base material 4 (as impact-absorption layer 8), it is not limited thereto; the structure having impact-absorption layer 7 only (between electrodes 6 and base material 4) or the structure having impact-absorption layer 8 only (between coil 5 and base material 4) also enhances impact resistance of the component. For further increase in impact-resistance, it is preferable to have impact-absorption layer 7 between electrodes 6 and base material 4 and impact-absorption layer 8 between coil 5 and base material 4.

Besides, the thickness of each of impact-absorption layers 7 and 8 should preferably be determined in the range of 10 nm to 2 μm inclusive. Having a thickness not smaller than 10 nm produces the effect of improving impact resistance of the component. On the other hand, having a thickness not greater than 2 μm allows base material 4 to ease the stress on coil 5 via electrodes 6, maintaining a proper shape of base material 4.

When impact-absorption layer 7 is formed of an air gap, it is preferable that the opening of impact-absorption layer 7 should be sealed with stopper layer 9 made of silicone resin or the like. Stopper layer 9 prevents moisture from entering into impact-absorption layer 7. Moisture entry invites corrosion of coil 5 and electrodes 6, resulting in increased resistance value of them or distortion of them. Stopper layer 9 prevents the inconveniencies above. Furthermore, protecting coil 5 and electrodes 6 from distortion caused by corrosion allows impact-absorption layers 7, 8 to keep a proper thickness. The structure of the embodiment is effective in improving impact-resistance, easing the stress on coil 5 via electrodes 6 and therefore keeping a proper shape of base material 4.

The inductance component of the present invention offers high impact-resistance and therefore is useful for electronic equipment, such as a mobile phone.

What is claimed is:

1. An inductance component comprising:

a base material;

a coil formed in the base material; and an electrode electrically connected to the coil and disposed on an outside of the base material, wherein, an impact-absorption layer is disposed between the electrode and the base material.

2. The inductance component of claim 1, wherein the impact-absorption layer has a thickness between 10 nm and 2 μm inclusive.

3. The inductance component of claim 1, wherein a stopper layer is disposed at an opening of the impact-absorption layer.

4. An inductance component comprising:

a base material;

a coil formed in the base material; and an electrode electrically connected to the coil, wherein, an impact-absorption layer is disposed between the coil and the base material and is configured to surround all sides of the coil.

5. The inductance component of claim 4, wherein the impact-absorption layer has a thickness between 10 nm and 2 μm inclusive.

6. The inductance component of claim 4, wherein the thickness of the impact-absorption layer increases from a lower section toward an upper section.

* * * * *